US012766593B2

(12) United States Patent
Mishra et al.

(10) Patent No.: US 12,766,593 B2
(45) Date of Patent: Oct. 20, 2026

(54) DEVICE AND METHOD FOR SINTERING

(71) Applicant: FORSCHUNGSZENTRUM JÜLICH GMBH, Jülich (DE)

(72) Inventors: Tarini Prasad Mishra, Jülich (DE); Martin Bram, Jülich (DE); Olivier Guillon, Jülich (DE); Ralf Steinert, Titz (DE)

(73) Assignee: FORSCHUNGSZENTRUM JÜLICH GMBH, Jülich (DE)

( * ) Notice: Subject to any disclaimer, the term of this patent is extended or adjusted under 35 U.S.C. 154(b) by 501 days.

(21) Appl. No.: 18/278,941

(22) PCT Filed: Feb. 2, 2022

(86) PCT No.: PCT/EP2022/052394

§ 371 (c)(1),
(2) Date: Aug. 25, 2023

(87) PCT Pub. No.: WO2022/184359

PCT Pub. Date: Sep. 9, 2022

(65) Prior Publication Data

US 2024/0139805 A1 May 2, 2024

(30) Foreign Application Priority Data

Mar. 4, 2021 (DE) ..... 102021202076.3

(51) Int. Cl.
*B22F 3/00* (2021.01)
*B22F 3/105* (2006.01)

(52) U.S. Cl.
CPC ..... *B22F 3/003* (2013.01); *B22F 3/105* (2013.01); *B22F 2003/1051* (2013.01)

(58) Field of Classification Search
CPC ... B22F 3/003; B22F 3/105; B22F 2003/1051
See application file for complete search history.

(56) References Cited

U.S. PATENT DOCUMENTS

2019/0275588 A1* 9/2019 Le Godec ..... B22F 3/03
2022/0219986 A1* 7/2022 Hu ..... C04B 35/64

FOREIGN PATENT DOCUMENTS

DE 102018201205 A1 8/2019
JP 2002338370 A 11/2002
WO 2020236767 A1 11/2020

OTHER PUBLICATIONS

International Search Report with English Translation and Written Opinion for PCT Application No. PCT/EP2022/052394, dated May 13, 2022, 9 pages.

(Continued)

*Primary Examiner* — Brian D Walck
(74) *Attorney, Agent, or Firm* — Dickinson Wright PLLC

(57) ABSTRACT

The disclosure relates to a device and a method for sintering. The device for sintering comprises an electrically conductive first component, an electrically conductive second component and at least one electrically conductive surface element for heating a green body to be sintered. The first component and the second component are movable relative to each other and/or relative to the surface element such that an electrical circuit comprising the first component, the surface element and the second component can be closed by the relative movement. In this way, a rapid sintering process is enabled on an industrial scale. The device can be integrated in a particularly simple manner into existing sintering plants, for example, a FAST/SPS sintering plant.

20 Claims, 6 Drawing Sheets

(56) References Cited

OTHER PUBLICATIONS

Wang et al., "A general method to synthesize and sinter bulk ceramics in seconds," Science 368, pp. 521-526, (2020).
Hong et al., "Tailoring grain growth and densification toward a high-performance solid-state electrolyte membrane," Materials Today, vol. 42, Jan.-Feb. 2021, pp. 41-48.

* cited by examiner

DEVICE AND METHOD FOR SINTERING

CROSS-REFERENCE TO RELATED APPLICATION(S)

This present application is a national stage application of International Patent Application No. PCT/EP2022/052394, filed Feb. 2, 2022, which claims priority to German Patent Application No. 102021202076.6, filed Mar. 4, 2021, the disclosures of which are hereby incorporated by reference in their entireties.

The disclosure relates to a device and a method for sintering.

BACKGROUND

Sintering is a method for processing materials. In this, a shaped body of a material is heated and, if necessary, subjected to increased pressure, so that the shaped body is compacted due to diffusion processes. Sintering takes place at high temperatures which are, however, below the melting temperature of the main components, so that the shape of the workpiece is retained during sintering. Shrinkage of the workpiece occurs as the starting material is compacted. The total surface area and the interfacial energy are reduced. The shrinkage is superimposed by grain growth as the sintering time increases. Also in this case, the reduction of the interfacial energy is the main driving force. Sintering produces a solid workpiece, wherein properties such as hardness, strength and thermal conductivity can be influenced by suitable process parameters.

Ceramic and metallic components can be produced through sintering which have multiple applications in terms of their properties, such as hardness, strength, wear resistance, temperature resistance, thermal conductivity and electrical conductivity. Frequently, the sintering process is preceded by shaping, in which a green body is produced from starting materials that are usually in powder form. A green body is a shaped body of ceramic and/or metallic powder in the unsintered state. During sintering, the starting material is usually subjected to a temperature above 700° C. for metallic powders and above 1000° C. for ceramic powders. Due to the high temperatures involved, this method is technically complex and energy-intensive. With long holding times at sintering temperature, excessive grain growth can lead to undesirable properties of the manufactured component. In addition, the long duration of the method, which usually ranges from one hour to days, is a major disadvantage.

To shorten the duration, field-assisted sintering was developed, in which heating takes place by means of electric current. In this method, also known as field-activated sintering, "field assisted sintering technology" (FAST) or "spark plasma sintering" (SPS), an electric current (constant direct current, pulsed direct current or alternating current) is passed through the electrically conductive tool (=pressing mold consisting of an upper and lower punch and a die, all parts made of a conductive material such as graphite). The tool is heated via the Joule effect (=resistance heating). The heating rates in the region of $10^{2}$° C./min for the powder, which are usual for FAST/SPS and high compared to conventional sintering, result from the direct contact between the tool and the powder through heat conduction. If electrically conductive powders are sintered, additional direct heating of the powder takes place by current flow via the powder, which further increases the heating rate and the homogeneity of the temperature distribution. In addition, uniaxial pressure is applied to the powder via the hydraulically moved punch system of the FAST/SPS system, and sintering usually takes place under inert gas or vacuum.

On a laboratory scale, a method has been developed in which sintering can be carried out with a further significantly shortened duration. This is called "ultra-fast high temperature sintering" (UHS) and is described in the publications "A general method to synthesize and sinter bulk ceramics in seconds" by Wang et al, Science 368, 521-526 (2020), and "Tailoring grain growth and densification toward a high-performance solid-state electrolyte membrane" by Hong et al, Materials Today, Volume 42, January-February 2021, pp 41-48. The UHS method uses the resistance-induced heating of carbon mats to generate heat and transfer heat to the green body to be sintered particularly quickly. However, the method has so far only been used on a laboratory scale. So far, only samples with sizes in the region of 6 mm have been sintered.

The invention is based on the task of providing a device, a sintering plant and a method which enable rapid sintering on a technical scale. In particular, quasi-continuous or continuous sintering according to the UHS principle is to be made possible.

SUMMARY

The task is solved by the device according to claim 1 and the sintering plant and the method according to the additional claims. Advantageous embodiments are given in the subclaims.

A device for sintering is used to solve the task. The device comprises an electrically conductive first component, an electrically conductive second component, and at least one electrically conductive surface element for heating a green body to be sintered. The first component and the second component are movable relative to each other and/or relative to the surface element such that an electrical circuit can be closed by the relative movement. The electrical circuit comprises the first component, the surface element and the second component.

The electrical current heats the electrically conductive surface element very quickly and to high temperatures, so that the heat is made available to the green body very quickly. In this way, sintering is possible in very short times, typically within less than one minute.

The relative motion allows the green body to be sintered to be brought into the sintering position quickly, accurately and reproducibly. The sintering position is the position in which the green body is located during sintering. In this way, a (large-scale) technical implementation of the UHS process is made possible. The relative movement can be made to position the green body between the components. The closing of the circuit for heating the surface element is thus carried out with particularly little technical effort.

In other words, the two components transport the green body together with the at least one surface element. In this case, the circuit is closed as soon as the surface element contacts the components. The surface element is heated as soon as the surface element is arranged in an electrically conductive manner between the two components.

The first component and the second component are electrically conductive. In particular, the first component and/or the second component are produced from graphite or metal. The components may also be referred to as electrodes. In particular, the first component and/or the second component have a contact surface for contacting the surface element. In particular, the first component and/or the second component have an electrical connection area to which an electrical conductor can be connected. The electrical connection area is in particular not arranged on the contact surface.

The electrically conductive surface element is heated very quickly due to its resistance. The heat generated is rapidly transferred to the green body for sintering the green body, in particular by thermal radiation. Preferably, the surface element is in direct contact with the green body. In this, a surface of the green body touches a surface of the surface element. In this way, heat can also be transferred particularly quickly and with low losses by direct heat conduction. However, it is also possible that a small distance remains between the surface element and the green body.

A surface element is an element whose average height is small compared to its length and width. In particular, the average height is less than 1% of the length and/or width, preferably less than 0.1% of the length and/or width. The thickness of the surface element may be between 0.1 mm and 25 mm, in particular between 1 mm and 10 mm, preferably between 2 mm and 6 mm. These thicknesses have proved to be particularly useful, since if the thickness is too low, the high temperatures cannot be kept stable and very high currents are required for heating due to the small volume of the surface element. If, on the other hand, the thickness is too high, the heating and cooling rates are reduced. The surface element may have a length-specific resistance between 0.5 and 20 Ω·mm, for example between 1 and 12 Ω·mm, in particular between 2 and 5 Ω·mm and preferably between 3 and 4 Ω·mm.

In particular, the surface element is arranged or arrangeable between the first component and the second component such that when an electric current is applied to the first component and the second component, the electric current flows through the surface element and heats it. Typically, the at least one surface element is arranged such that it is heated due to resistance when the circuit is closed.

In one embodiment, the surface element includes carbon or consists of carbon. The surface element typically includes more than 50% carbon and preferably more than 95% carbon. In one configuration, the surface element includes or consists of carbon fibers. In one configuration, the surface element includes or consists of carbon nanotubes.

Alternative materials for the surface element may include conductive high temperature ceramics. In this case, the surface element may include or consist of silicon carbide, silicon nitride, tungsten carbide, titanium carbide, or mixtures thereof.

In one configuration, the surface element is mechanically flexible. This means that the surface element can be flexibly bent in such a way that it is arranged at an angle of 90° over a length of at most 5 mm. This improves the heat input into irregularly or differently shaped green bodies. In an alternative configuration, the surface element is rigid. In this case, it is in particular adapted to the sample geometry. For example, it can have a cavity or a contact side for contacting the green body, the contour of which is adapted to the contour of the green body. This can ensure a particularly reproducible process, especially for high quantities.

In one configuration, the electrically conductive surface element is a felt, a paper, a nonwoven or a fabric. It can be, for example, a carbon felt, i.e., a felt comprising or consisting of carbon, a carbon paper, i.e., a paper comprising or consisting of carbon, a nonwoven of carbon fibers or a fabric of carbon fibers. Like a nonwoven, a felt is a textile structure made of a disordered fibrous material. In contrast to a nonwoven, the fibers of the felt are mechanically consolidated and thus typically cannot be separated from one another or can only be separated with difficulty. In one configuration, the fibers are partly or entirely carbon fibers.

Carbon is suitable for rapid heating and is particularly temperature-resistant. This requires that the oxygen partial pressure is sufficiently low so that the carbon does not oxidize or burn. For example, the device is configured such that the surface element can be heated in an inert gas atmosphere and/or in a vacuum.

An electrical circuit can be closed by the relative movement. By this is meant that the relative movement produces an electrically conductive contact so that subsequently an electrical current can flow through the first component, the at least one surface element and the second component. In particular, the electrical circuit can be selectively opened or closed by the relative movement. It is not necessary that closing the circuit automatically causes a current to flow. Of course, the circuit may comprise an additional switch, for example as part of a suitable control of the device, and may be closed by this. In particular, the circuit further comprises suitable contact structures and the power source or connectors for connecting the power source.

In one configuration, the relative movement occurs between the first component and the second component. For example, it may be a movement from an open position of the device to a closed position of the device. In this, the two components are moved towards each other. This takes place in particular after positioning of the green body in the sintering position and/or at the surface element. The relative movement can be realized by moving the first component, the second component or both components.

In another configuration, the relative movement takes place between the two components on the one hand and the surface element on the other. Here, the first component and the second component can be moved uniformly, in particular together.

In one embodiment, the device is configured for integration into a FAST/SPS sintering plant and/or into a continuous furnace. In particular, the first component and the second component are configured such that they can be mechanically and electrically connected to existing punches.

In one embodiment, a first region of the surface element is electrically conductively connectable or connected to the first component and/or a second region of the surface element is electrically conductively connectable or connected to the second component.

The first region is different from the second region. In particular, the two regions are located at different length and/or width positions of the surface element and not at opposite sides at the same length and width position of the surface element.

In particular, a third region is located between the first region and the second region, which is typically heated the fastest and/or the most when the circuit is closed. In particular, the third region is mechanically attached solely via the first region and the second region. The third region is typically used for heat generation and heat transfer to the green body.

The first region of the surface element may be directly or indirectly connected or connectable to the first component. The second region of the surface element may be directly or indirectly connected or connectable to the second component.

In particular, the first region is electrically isolated from the second component. This may be realized, for example, by a sufficient distance between the first region and the second component and/or by an electrical insulator located between the first region and the second component. In particular, the second region is electrically isolated from the first component. This can be realized, for example, by a sufficient distance between the second region and the first component and/or by an electrical insulator located between the second region and the first component. In this way, current flow is forced through the surface element. A short circuit bypassing the surface element is prevented in this way.

In one configuration, two surface elements are present which are arranged one above the other, wherein the green body is arranged between the surface elements. In the regions adjacent to the green body, in which the surface elements overlap, they electrically conductively contact one another. Accordingly, a first region of a first surface element is electrically conductively connected to the first region of the second surface element, and a second region of the first surface element is electrically conductively connected to the second region of the second surface element. Here, a first region of the first surface element may contact the first component. Indirectly, the first region of the second surface element is also electrically conductively connected to the first component. Accordingly, a second region of the second surface element may contact the second component. Indirectly, the second region of the first surface element is also electrically conductively connected to the second component. Analogous to the above, the first region of the second surface element is electrically isolated from the second component and the second region of the first surface element is electrically isolated from the first component.

In one embodiment, one side of a sintering position of the green body is delimited by a surface element and/or another side of the sintering position of the green body is bounded by a counter element.

In particular, the sintering position is arranged or can be arranged between the first component and the second component. The sintering position may also be referred to as a receiving space for receiving the green body for sintering. The green body is located in the sintering position during sintering.

In particular, in this embodiment, the device includes only one electrically conductive surface element. In this embodiment, the green body is heated from one side only. In particular, this can be used to sinter coatings applied to workpieces. The coating is then the green body in the sense of the disclosed concepts. In this case, the heat input from one side is sufficient and/or may even be required to protect the substrate on which the coating is located from excessive heat influence.

In particular, the two sides are opposite sides. For example, the sintering position is bounded from below by the surface element and from above by the counter element or vice versa. The counter element serves to limit the sintering position. For example, it can hold the green body in position during sintering, serve to transport the green body into the sintering position, and/or serve to transport the sintered body out of the sintering position. The counter element may have the same dimensions and/or the same shape as the surface element or differ from it. It can be stationary, for example attached to one of the components, or it can be arranged movably.

In particular, the counter element is temperature resistant up to above 1000° C., preferably up to above 1600° C. The temperature resistance can refer to an inert gas or vacuum atmosphere. In particular, the counter element is inert in such a manner that it does not undergo any chemical reactions with the green body, other objects and/or the atmosphere at said temperatures. In particular, the counter element is electrically non-conductive. The counter element may be produced from a ceramic material. The counter element is typically also a flat element. For example, the counter element may be a nonwoven, a felt, a paper, a fabric, and/or a tape. The counter element may be circulating, quasi-endless, or limited in area. The counter element may be flexible or flexibly arranged to compensate for shrinkage of the green body during sintering and/or to reduce mechanical stress on the green body. The counter element may consist of the same material as the surface element.

In one embodiment, the device comprises two electrically conductive surface elements, wherein each surface element delimits one side of a sintering position of the green body. In other words, the at least one electrically conductive surface element includes two surface elements. In particular, the two sides are opposite sides also in this embodiment. For example, the sintering position is delimited from above and from below by a respective surface element. The surface elements may be configured alike.

In particular, the two surface elements are arranged parallel to each other and/or one above the other. Accordingly, the two first regions of the surface elements may lie electrically conductively on top of each other and the two second regions of the surface elements can lie electrically conductively on top of each other. The sintering position may be formed between the two third regions of the surface elements. In this embodiment, heating takes place from both sides. In this way, green bodies can be heated particularly quickly and evenly.

In one embodiment, the device is designed to allow relative movement of the first component and the second component along a common axis. In particular, a sintering position of the green body is accessible in an open position. In particular, in a closed position, electrical contact is established between the first component, the surface element and the second component.

In other words, the two components can be moved toward and away from each other. When the sintering position between the first component and the second component is accessible, a sintered component can be removed therefrom and/or the green body to be sintered can be placed therein. In this case, the circuit is not closed. When the circuit is closed, heating and thus sintering takes place. The sintering position is then not accessible.

The electrical contact between the first component, the surface element and the second component can be such that there is an electrical contact between the first component and the surface element on the one hand and an electrical contact between the surface element and the second component on the other hand.

In particular, the axis is a straight axis. In this case the movement is a linear movement.

In one embodiment, a quasi-continuous process can take place in which the supply and removal of the green bodies and/or bodies to be sintered is continuous, and the sintering itself takes place during interruptions in the supply and removal. Such a cycle, which can be repeated many times, then comprises, for example, an opening, a removal of the sintered body, an arrangement of the green body and a closing for sintering.

In one configuration, a surface element is attached to the first component or to the second component. Thus, when the respective component is moved, the surface element is also moved. The sintering position may be adjacent to the surface element. The sintering position may be located between two surface elements. A second surface element may be attached to the respective other component. Thus, in the open position, the sintering position located between the surface elements is accessible.

In one configuration, the device comprises a drive for the first component and/or for the second component, with which the relative movement can be performed. In particular, the drive is configured to apply a compressive force along the axis between the first component and the second component.

In one embodiment, the device comprises a first conveying device for moving the surface element or a counter element in a substantially straight line. Thus, a green body and/or a sintered body disposed on the surface element or the counter element can be moved relative to the first component and the second component.

In particular, the first conveying device serves to convey the green body to the sintering position and/or to convey the sintered body away from the sintering position. In particular, the first conveying device is configured such that the surface element and/or the counter element is moved in a substantially horizontal orientation. Thus, the respective body can be easily placed thereon. In one configuration, the surface element is designed as a circulating belt that is moved by means of the first conveying device. In the region between the outer rollers, this belt executes a straight-line movement in sections.

This embodiment enables a technically less complex, quasi-continuous sintering process in which the green body and the sintered bodies can be transported by means of the conveying device.

If the relative movement is a movement along an axis, the movement of the surface element and/or the counter element may in particular be aligned perpendicular to the direction of the relative movement.

In a further embodiment, the surface element is provided in a rolled-up form on a roll. The first conveying device is configured to hold and transport the partially unrolled surface element.

In other words, the surface element is provided in a form rolled up on a roll in a quasi-endless manner so that it is used only once. It has been found that, depending on the green bodies to be sintered and the selected process parameters, wear or damage to the surface element may occur during sintering. To prevent quality losses in subsequent sintering processes, the surface element is used only once in this embodiment. This enables a particularly high and reproducible quality of the sintering process.

In particular, the first conveying device comprises the rotatable roller that includes the rolled-up surface element. The first conveying device further comprises in particular a second roller spaced therefrom, which holds the surface element on the other side. The first conveying device further comprises in particular a drive for a movement of the surface element. The drive can drive the roller with the rolled-up surface element and/or the second roller and/or engage the surface element at another position. The sintering position is typically located between the roller with the rolled-up surface element and the second roller. In particular, the device further comprises means for discharging and/or stacking, for example rolling up, the used surface element. This can be collected in this way.

In one embodiment, the surface element and/or the counter element is designed as a circulating belt. The first conveying device may comprise two conveying rollers for holding and moving the circulating belt.

In other words, the surface element is designed as a conveyor belt. This makes it possible to transport the body to be sintered or the sintered body in a particularly simple manner. This enables a particularly simple quasi-continuous method.

A conveyor roller is a rotatably mounted roller configured to hold and move the circulating belt. A conveyor roller may be driven or not driven.

In a further embodiment, the device comprises a second conveying device for moving a further surface element or counter element in a substantially straight line. Thus, a green body and/or a sintered body arranged on the surface element or the counter element can be covered with the further surface element or counter element when moved relative to the first component and the second component.

In this case, the counter element is a flat element. In this embodiment, the sintering position is thus delimited from below as well as from above by a flat element. Among the flat elements is at least one surface element and possibly one counter element.

In one configuration, a first conveying device and a second conveying device are provided. At least one of the conveying devices serves to move a surface element. The other conveying device may also serve to move a surface element or to move a counter element. In particular, the movement by means of the first conveying device and the movement by means of the second conveying device take place in parallel at least in sections. The first component and the second component are typically arranged in the parallel section. This embodiment enables a particularly operationally reliable quasi-continuous method in which the heating can take place on one side or on two sides.

A further surface element may also be provided in a form rolled up on a roll. The second conveying device may be configured to hold and transport the partially unrolled further surface element.

In a further embodiment, the first component and the second component are configured as rotatably mounted, roller-shaped electrodes. These are configured in particular to contact the surface element electrically conductively with their circumferential surface when the surface element is moved relative to the first component and the second component. This movement may be essentially straight-line.

This embodiment allows, in a technically simple manner, a continuous process in which the feeding of the green body, the sintering, and the removal of the sintered bodies are performed without interruptions.

In one embodiment, the device comprises a first counter component opposite the first component and/or a second counter component opposite the second component. The first component and the first counter component may be arranged to apply a compressive force to a first region of the surface element from opposite sides. The second component and the second counter component may be arranged to exert a compressive force on a second region of the surface element from opposite sides.

The first component and the second component may be arranged on the same side of the surface element. This enables a particularly space-saving arrangement. In particular, the first counter component and/or the second counter component is electrically non-conductive and/or heat-resistant. The application of force enables an improved support during sintering and/or a more precise transport of the green bodies and sintered bodies. In addition, the application of force may improve the sintering process. For example, sintering may be performed under pressure.

In one configuration, the device is configured such that relative movement between the first component and the first counter component along a first axis is possible. In one configuration, the device is configured such that relative movement between the second component and the second counter component along a second axis is possible. The first axis and the second axis may be different axes and may be parallel. In one configuration, the first component and the second component are jointly movable relative to the surface element, the first counter component, and/or the second counter component. In one configuration, the first counter component and the second counter component are jointly movable relative to the surface element, the first component and/or the second component. For example, the two components may be mechanically connected to each other.

In one configuration, the first component and the first counter component are configured as rollers and are arranged to rotate relative to each other. In particular, they are arranged such that they jointly enable transport and/or application of force to a first region of the surface element arranged therebetween. In one configuration, the second component and the second counter component are configured as rollers and are arranged to rotate relative to each other. In particular, they are arranged to jointly enable transport and/or application of force to a second region of the surface element arranged therebetween. In particular, the first component and the second component are arranged to rotate about the same axis of rotation. In particular, the first counter component and the second counter component are arranged to rotate about the same axis of rotation. In particular, the axis of rotation of the components is parallel to the axis of rotation of the counter components.

In a further embodiment, the device comprises a manipulator for moving, at least in sections, the green body to be sintered to a sintering position and/or for moving, at least in sections, the sintered body away from the sintering position.

The manipulator is configured for moving the green body along at least a section of the path to the sintering position and/or for moving the sintered body along at least a section of the path away from the sintering position. In particular, the manipulator is configured to place the green body on the surface element and/or the counter element and/or to remove the sintered body from the surface element and/or the counter element.

In one configuration, the manipulator is configured to directly access the sintering position. It can position the green body there and/or remove the sintered body. This is particularly the case if the relative movement between the first component and the second component is along an axis.

In another configuration, the manipulator is configured to access another position of the surface element and/or the counter element that is not between the first component and the second component. In particular, the first conveying device may serve to transport the green body from the other position to the sintering position and/or to transport the sintered body from the sintering position to the other position.

This embodiment enables a completely automated process. In this way, high throughputs can be achieved without compromising quality. Control based on detected process parameters and flexible reaction to deviations are also possible in this way.

In one further embodiment, the device comprises a pyrometer for determining a temperature of the surface element. In particular, a continuous cavity is arranged in the first component or in the second component, through which a viewing axis runs between the pyrometer and the surface element.

Here, the temperature of the surface element and thus a central parameter of the sintering process can be continuously detected. This enables precise control of the sintering process. The quality of the sintered bodies and the reproducibility of the properties are further increased. In addition, automated control of the process is facilitated.

A further aspect of the invention is a sintering plant, in particular a continuous furnace or a FAST/SPS sintering plant. The sintering plant comprises a device for sintering according to the invention. In particular, the sintering plant comprises a power source for applying an electric current through the electric circuit. The electrical circuit comprises the first component, the surface element and the second component. All features, configurations and effects of the device described above also apply to the sintering plant and vice versa.

A FAST/SPS sintering plant is a device suitable for performing the FAST/SPS method ("Field assisted sintering technology" or "Spark Plasma Sintering"). In the case of a FAST/SPS sintering plant, it has in particular an upper punch and a lower punch which are designed as electrical contacts. These punches are usually additionally configured for uniaxial pressing of a green body, wherein in the conventional method two geometrically simple components (cylinder or cuboid) and a die, which enclose the powder, are arranged between the punches. Instead, the device according to the disclosed concepts is now arranged between the punches. The punches are again designed as electrical contacts. For example, the first and second components can be positioned and, if necessary, fixed between the punches in such a way that the upper punch electrically contacts the first component and the lower punch electrically contacts the second component, or vice versa. The power source is then connected or connectable to the two punches. The movement of a punch then takes place together with the movement of the corresponding component. The punches of the FAST/SPS sintering plant consist in particular of a temperature-resistant metal alloy and/or graphite. The punches are usually water-cooled. In particular, the sintering plant has a control for controlling and/or regulating the current flow. In particular, at least one of the punches is arranged to be hydraulically movable.

A further aspect of the disclosure is a method for sintering a green body. This comprises providing a device having an electrically conductive first component, an electrically conductive second component, and at least one electrically conductive surface element. In particular, the device is a device according to the disclosed concepts. The method may further comprise arranging a green body to be sintered on the surface element. The method may further comprise performing a relative movement between the first component and the second component or between the first component and the second component, on the one hand, and the surface element, on the other hand. The method may further comprise applying an electrical current through the first component, the at least one surface element, and the second component. The electrical current may cause heating of the surface element such that the green body is sintered.

All features, configurations and effects of the device described at the beginning also apply to the method and vice versa.

The arrangement of the green body and the performance of the relative movement may be performed successively or simultaneously at least in time sections. The performance of the relative movement and the application of the electrical current may be performed successively or simultaneously at least in time sections. The green body is arranged in particular in such a way that the green body contacts the surface element. For example, the green body is placed on the surface element. The green body may be arranged between two surface elements or two sections of surface elements. The green body may be placed between the surface element and a counter element. The surface element may be circulating, quasi-endless or a section limited in area.

In one embodiment, the current is applied for a period of time less than 5 minutes, preferably less than 2 minutes and in one embodiment less than one minute or less than 30 seconds. In one embodiment, the method is performed such that complete compaction is achieved in a period of time less than 5 minutes, preferably less than 2 minutes, and in one embodiment less than one minute or less than 30 seconds. In one embodiment, the surface element, a surface of the green body facing the surface element and/or the entire green body is heated at a temperature change rate between $10^3$ and $10^{4\circ}$ C./min and/or to a temperature above 1500° C., in particular above 2000° C. and in one configuration above 2500° C. The maximum temperature may be 3000° C.

In one configuration, a near-net-shape body, in particular with a complex geometry, is produced as the sintered body. In one configuration, a component for an electrochemical cell (e.g., battery, fuel cell, and/or electrolytic cell) is produced as the sintered body. In one configuration, the sintered body produced is a porous body, such as a porous electrode. In one configuration, the sintered body produced is a body that is impervious to gases and/or liquids. In one configuration, the sintered body produced is a multiphase composite material and/or an ion-conducting electrolyte, for example a single-phase membrane layer. In one configuration, the green body is produced using a generative manufacturing process, e.g., 3D printing, or screen printing, dip-coating, spin-coating, inkjet printing, electrophoresis, or thermal spraying. In particular, the green body is a precompressed green body, for example a preformed powder compact, and/or an inherently stable green body. Alternatively, the green body may be a loose powder arranged in a combustible mold, for example made from cardboard, such that the mold burns during sintering. Alternatively, the green body may be a loose powder arranged in a mold that is sintered. Subsequently, the mold is separated (lost-mold principle). In one embodiment, the lost mold consists of graphite. In one embodiment, the green body is a coating arranged on a substrate. In this case, the heating is performed in particular only from the side of the coating. In one embodiment, the green body is a laminate of, for example, film-cast layers, a part of a laminate, a multilayer material composite, or a part of a multilayer material composite. Due to the short sintering time and the targeted heat input, undesirable disturbances, for example due to interfacial reactions or material decomposition, are minimized or completely avoided.

In one embodiment of the method, the surface element and/or a counter element is moved in a substantially straight line. The green body may be arranged on the surface element or the counter element and may be moved together therewith relative to the first component and the second component. After completion of the substantially straight-line movement, the relative movement may take place. In this, the first component and/or the second component may be moved, for example, substantially in a straight line. Thus, a circuit through the first component, the surface element and the second component can be closed. In particular, the circuit passes through the first component, a first region of the surface element contacting the first component, a third region of the surface element, a second region of the surface element contacting the second component, and the second component in this or the reverse order. The surface element or the counter element may be moved in a substantially straight line after sintering is complete. The sintered body may be arranged on the surface element or the counter element and may be moved together with the surface element or the counter element relative to the first component and the second component.

In other words, movement to the sintering position occurs first and is stopped once the green body reaches the sintering position. The circuit is closed and sintering takes place. The sintered body is then moved away from the sintering position. Sintering can take place within a maximum of 30 seconds, a maximum of 20 seconds or within about 10 seconds. Immediately afterwards, the straight-line movement of the surface element and/or the counter element can be continued.

The essentially straight-line (rectilinear) movement of the surface element or counter element, which transports the sintered body away from the first component and the second component, can simultaneously move a subsequent green body relative to the first component and the second component to bring it into the sintering position. In this way, a quasi-continuous process is provided, which enables a high throughput with at the same time exact setting of reproducible sintering parameters. The quality of the sintered bodies is thus particularly high and constant. In particular, the surface element and/or the counter element in this embodiment are present as a circulating belt or quasi endless.

In another embodiment, the first component and the second component are each designed as a rotatably mounted, roller-shaped electrode. The relative movement is performed as a substantially straight-line movement of the surface element. The first component and the second component electrically conductively contact the surface element during the relative movement with a respective circumferential surface. In this way, a continuous process is provided that enables high throughput with low technical effort.

In the following, exemplary embodiments are also explained in more detail with reference to figures. Features of the exemplary embodiments can be combined individually or in a plurality with the claimed objects, unless otherwise indicated. The claimed areas of protection are not limited to the exemplary embodiments.

DETAILED DESCRIPTION

Figure 2:
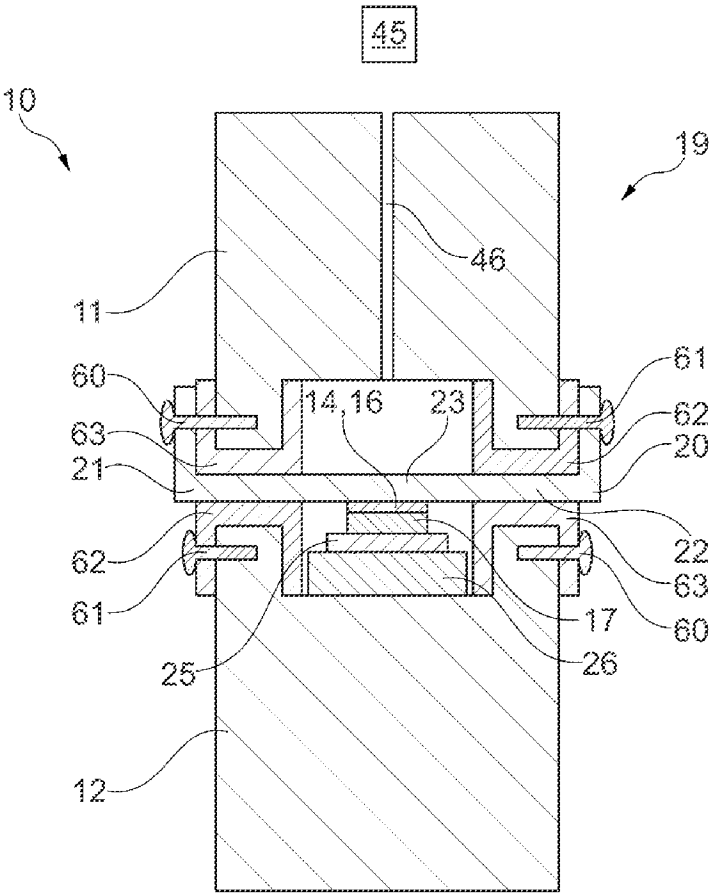
FIG. 2: a second exemplary embodiment of a device for sintering.
Figure 1:
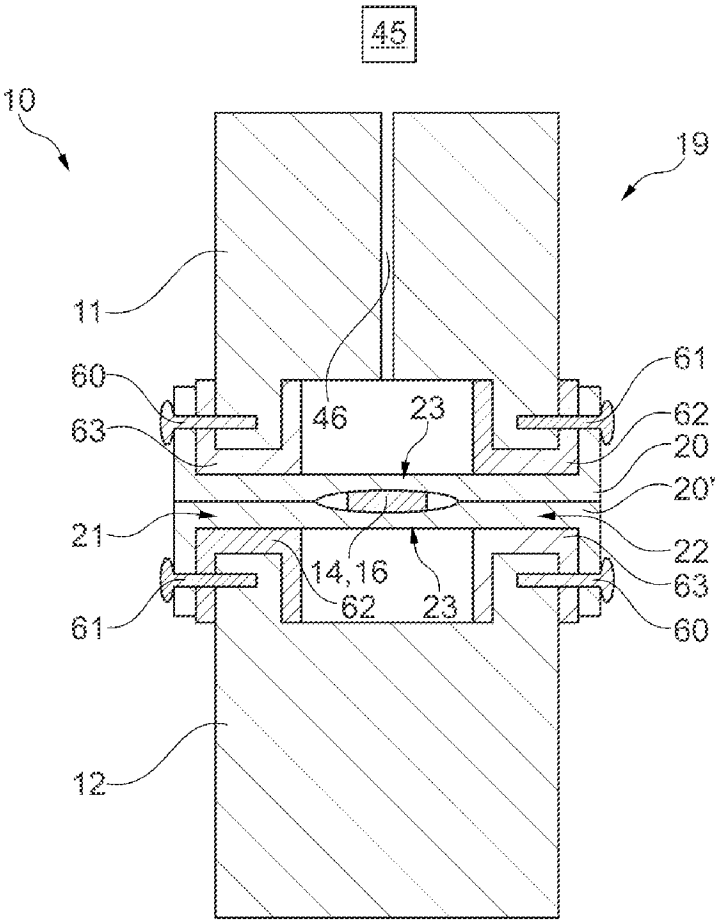
FIG. 1: a first exemplary embodiment of a device for sintering.

FIGS. 1 and 2 each show a section of a device 10 for sintering. Both devices 10 comprise a first component 11 shown above and a second component 12 shown below. The components 11, 12 are cuboid-shaped and consist of graphite. In the middle region, both the first component 11 and the second component 12 have a cavity inside. In other words, the components 11, 12 are U-shaped.

In the exemplary embodiment shown in FIG. 1, a surface element 20 made of carbon felt is attached to the first component 11. There is also a surface element 20' made of carbon felt attached to the second component 12. The surface elements 20, 20' are each guided partially around the legs of the U-shape and fastened laterally with screws. In the center, they do not rest on the material of the respective component 11, 12. The two surface elements 20, 20' have the same shape and design. A closed position is shown in which the surface elements 20, 20' lie flat against one another and form a sintering position 16 between them, in which the green body 14 to be sintered is received. A first region 21 of each surface element 20, 20' is clamped on the side shown on the left between the mutually opposite legs of the U of the two components 11, 12. A second region 22 of each surface element 20, 20' is clamped between the opposite legs of the U of the two components 11, 12 on the side shown on the right. Between them is a third region 23 of each surface element, which is in direct mechanical contact with the green body 14.

A relative movement of the two components 11, 12 apart along a vertical axis common to the two components 11, 12 leads to an open position (not shown) in which the sintering position 16 is freely accessible so that a sintered body can be removed and/or a green body 14 can be introduced.

In the closed position 19 shown, electrical contact is established between the first component 11, the two surface elements 20, 20' and the second component 12. In the exemplary embodiment shown, the first component serves as the positive pole and the second component 12 serves as the negative pole. In particular, a direct current or a pulsed direct current is applied. However, it is not excluded that an alternating current is used. According to the technical direction of current, the current thus flows from the first component 11 to the second component 12. On the right-hand side, an electrical insulator 62 is arranged between the first component 11 and the surface element 20. An electrical conductor 63 is arranged between the surface element 20' and the second component 12. Similarly, an electrical conductor 63 is arranged on the left-hand side between the first component 11 and the surface element 20. In contrast, an electrical insulator 62 is arranged between the surface element 20' and the second component 12. The insulators 62 and/or the conductors 63 are in particular cap-shaped and are placed on the respective leg of the U. The conductors 63 may be produced from the same material as the components 11, 12, for example from graphite, and serve not only to make electrical contact but also to protect the components 11, 12 from wear. The cap-shaped design allows easy replacement in case of wear. In one configuration, the conductors 63 can also be omitted.

Accordingly, the current flows from the first component 11 on the left side via the electrical conductor 63 into the first region 21 of the upper surface element 20. On the left side, the insulator 62 prevents current from flowing into the upper surface element 20. Since the two surface elements 20, 20' are adjacent to each other in this region, current also flows in the first region 21 of the lower surface element 20'. The insulator 62, however, prevents current from flowing directly into the second component 12. The current therefore flows from left to right in both surface elements 20, 20' via the third region 23 of each surface element 20, 20' into the respective second region 22. Heating is at a maximum in the third region 23, since there is no contact with either of the components 11, 12 here and thus there is no significant heat flow away from the surface element 20, 20' or the green body 14. The current flows on the right side from the second region 22 via the electrical conductor 63 into the second component 12, thus ensuring that the electrical current flows completely through the surface element or surface elements 20, 20' to generate heat energy for sintering.

The fastening of the surface elements 20, 20' in the region of the electrical insulators 62 is realized with electrically non-conductive screws 61, in particular made of boron nitride. The screws 61 extend through the respective insulator 62 into the material of the respective component 11, 12. They may also serve to fasten the respective cap to the respective component. Alternatively, it is also possible to fasten the surface elements only to the insulator 62. In this case, conventional screws can be used. The surface elements 20, 20' are fastened in the region of the electrical conductors 63 using electrically conductive screws 60, in particular made of graphite. The screws 60 run through the respective conductors 63 into the material of the respective component 11, 12. They can also be used for fastening the respective cap to the respective component.

A vertical, straight cavity 46 is arranged in the first component 11, above which a pyrometer 45 is located. This is used for continuous non-contact temperature measurement of the third region 23 of the surface element 20 and thus for monitoring the temperature during sintering. The cavity 46 provides a viewing axis between the pyrometer 45 and the surface element 20. The cavity 46 may have a channel-like configuration, for example when implemented as a bore having a circular cross-section.

A major advantage of the device 10 shown here is its suitability for simple integration into existing systems for "field assisted sintering technology" (FAST) or "spark plasma sintering" (SPS). In particular, for this purpose, the first component 11 and the second component 12 are positioned between the two punches of the system and, if necessary, fixed in position. The electrical current can be applied to the two components 11, 12 via the two punches. The punches can perform the vertical relative movement of the two components 11, 12. In this way, the operating conditions necessary for sintering according to the disclosed concepts can be easily realized by means of the existing equipment. The established control of this equipment and the possible operating parameters, such as the power supply, are optimally suited for performing the method according to the disclosed concepts. The existing process control and control, e.g. including the setting of a vacuum or an inert gas atmosphere, for example of Ar, $Ar/H_2$ or $N_2$, can be used. Detection and control of gas pressure and gas composition are possible. Such systems allow sintering of workpieces up to 500 mm in diameter. They are established, commercially available and meet safety requirements. Optionally, the existing heating, debinding and cooling zones can also be used. Available manipulators for these plants allow for an automated method.

In contrast to FIG. 1, only one surface element 20 is present in the exemplary embodiment shown in FIG. 2. This is arranged at the top and attached to the first component 11. The lower side of the sintering position 16 is delimited by a counter element 25, which in the example shown here carries the green body 14. The counter element 25 is designed as a flexible felt element which compensates for shrinkage of the component during sintering. An inert support element 26 is located below the counter element 25. In contrast to the example shown here, the felt element can also be dispensed with. In this case, the support element 26 serves as the counter element for limiting the sintering position and/or for holding the green body 14.

In this case, the green body 14 to be sintered is a coating arranged on a substrate 17. The substrate 17 lies on the counter element 25. The coating contacts the surface element 20. The current thus flows here from the first component 11 into the first region 21 located on the left side of the surface element 20, to the right through the third region 23, on to the second region 22 of the surface element 20 and from there directly into the second component 12. Apart from the differences described, the example of FIG. 2 is constructed analogously to the example of FIG. 1 described above. In this respect, reference is made to the above.

Figure 3:
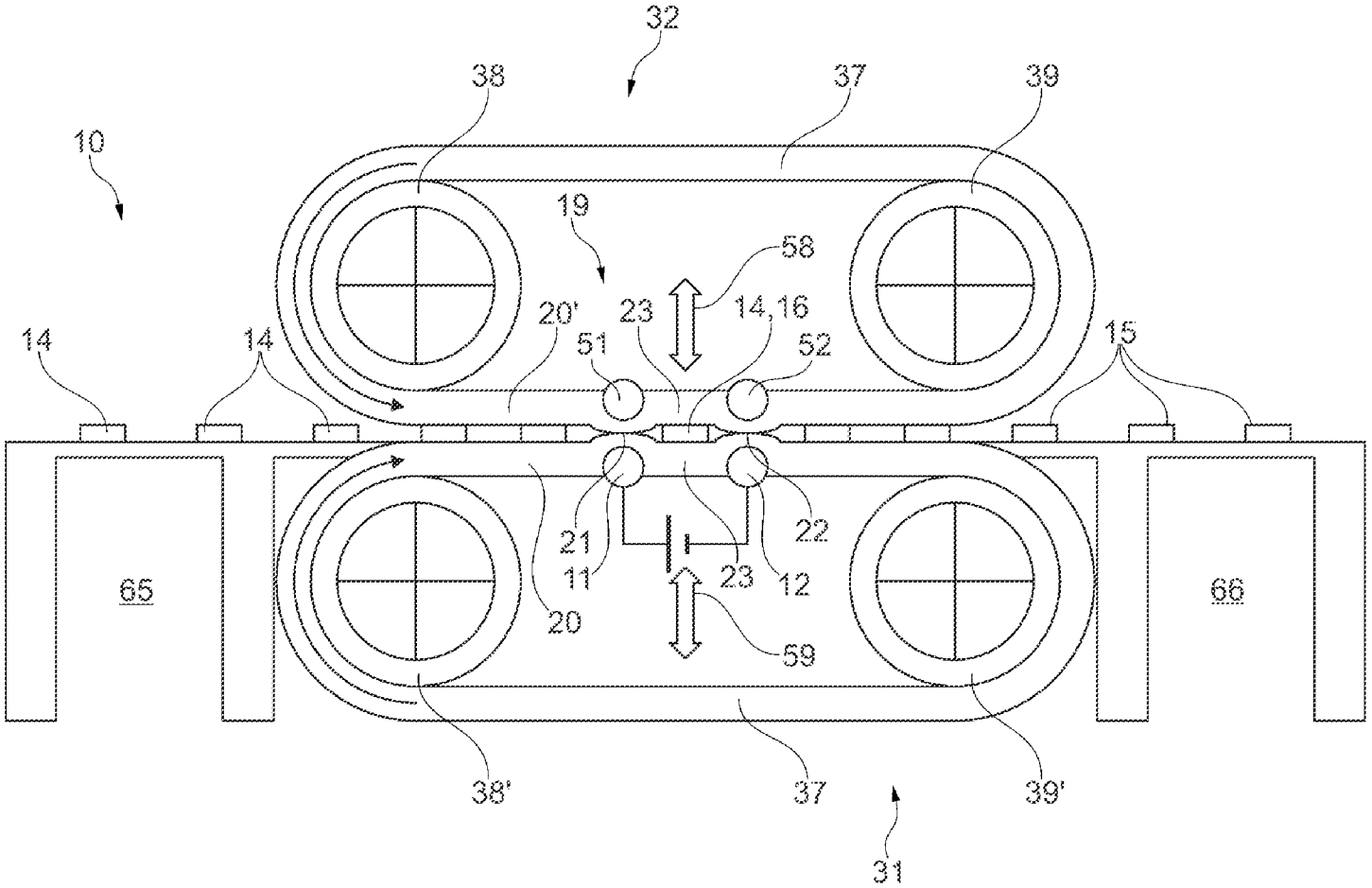
FIG. 3: a third exemplary embodiment of a device for sintering.

A further exemplary embodiment is given in FIG. 3. The device 10 comprises a first conveying device 31 with two conveying rollers 38', 39' which move a surface element 20, which is designed as a circulating belt 37, in the manner of a conveyor belt. This is indicated by the arrow in the conveyor roller 38'. Green bodies 14 can be arranged on the surface element 20 in a loading zone 65 indicated schematically on the left, for example by means of a manipulator (not shown). Between the conveying rollers 38', 39', there is thus a straight-line (rectilinear) movement of the surface element 20 and the green body located thereon relative to the first component 11 and to the second component 12. The exemplary embodiment shown here also has the advantage that the device 10 can be integrated in a simple manner into an existing system, for example a continuous furnace, in order to use the equipment existing there as described above. The first conveying device 31 can be part of a continuous furnace.

The two components 11, 12 are designed here as rod-shaped electrodes with a circular-cylindrical cross-section to minimize the mechanical load on the surface element. The electrodes run in particular over the entire width of the surface element. They are movable individually or together along respective axes in the vertical direction along the arrow 59 to allow relative movement with respect to the surface element 20 with which the circuit through the first component 11, the surface element 20 and the second component 12 can be closed. The power source connected to both components 11, 12 is shown. Again, similar to FIG. 1, the current flows from the first component 11 into the first region 21, thence through the third region 23 into the second region 22, and thence into the second component 12. In particular, the third region 23 is strongly heated.

The device 10 further comprises a second conveying device 32 having two conveying rollers 38, 39 which move a circulating surface element 20', which is configured as a circulating belt 37, in the manner of a conveyor belt. The second conveying device 32 is mirrored with respect to the first conveying device 31 about a horizontal axis and is otherwise constructed in the same manner as the first conveying device 31. Accordingly, reference is made to above. In one embodiment, the upper conveying device may have a shorter length than the lower conveying device so that the lower conveying device it overhangs the upper conveying device on both sides. In this way, it is easier to place the green body 14 on the lower conveying device and remove the sintered body 15.

The device comprises a first counter component 51 opposing the first component 11 and a second counter component 52 opposing the second component 12. The counter components 51, 52 are movable individually or with each other along respective axes in a vertical direction along the arrow 58 to allow relative movement with respect to the surface element 20' and to apply a compressive force to the first region 21 and the second region 22 of the surface element 22. In the configuration shown, the components 11, 12 and the counter components 51, 52 are in a closed position. It can be seen that the surface elements 20, 20' are thus deformed and enclose the green body 14 for sintering. In this position, both surface elements 20, 20' are immobile and both conveying devices 31, 32 are stopped. When the circuit is closed, for example by a switch and/or control, both surface elements 20, 20' are heated due to resistance, so that heating of both sides of the green body 14 occurs. Sintering may occur within 10 seconds, for example. After sintering, an open position is reached by upward movement of the counter elements 51, 52 and downward movement of the components 11, 12, in which the surface elements 20, 20' are again freely movable and the movement of the conveying devices 31, 32 is restarted. In this way, a quasi-continuous process is provided. The sintered bodies can be removed from the surface element 20 in an unloading zone 66 shown schematically on the right, for example by means of a manipulator (not shown).

Alternatively to the configuration shown here, the two upper elements could also be designed as first component 11 and second component 12 and the two lower elements as first counter component 51 and second counter component 52.

Figure 4:
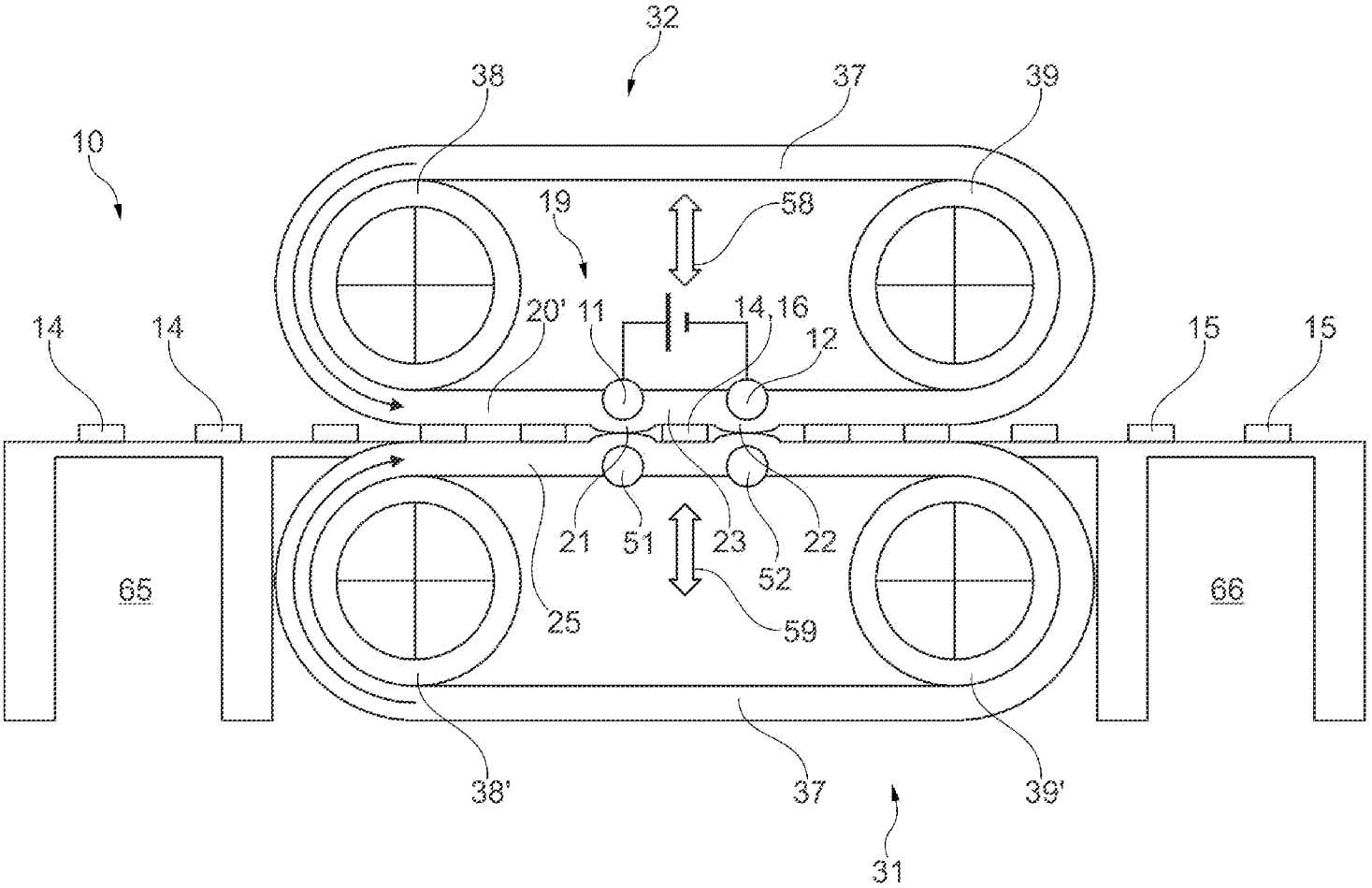
FIG. 4: a fourth exemplary embodiment of a device for sintering.

The exemplary embodiment shown in FIG. 4 has a similar structure, so that only the differences are discussed here and otherwise reference is made to above. Deviating from FIG. 3, here instead of the lower surface element an electrically non-conductive counter element 25 is arranged in the form of a circulating belt 37, which is moved with the first conveying device 31 and on which the green bodies 14 are arranged. The second conveying device 32 above, on the other hand, moves the surface element 20, in the vicinity of which the first component 11 and the second component 12 are arranged. In this way, the green body 14 is heated from above on one side, for example for sintering a coating.

Figure 5:
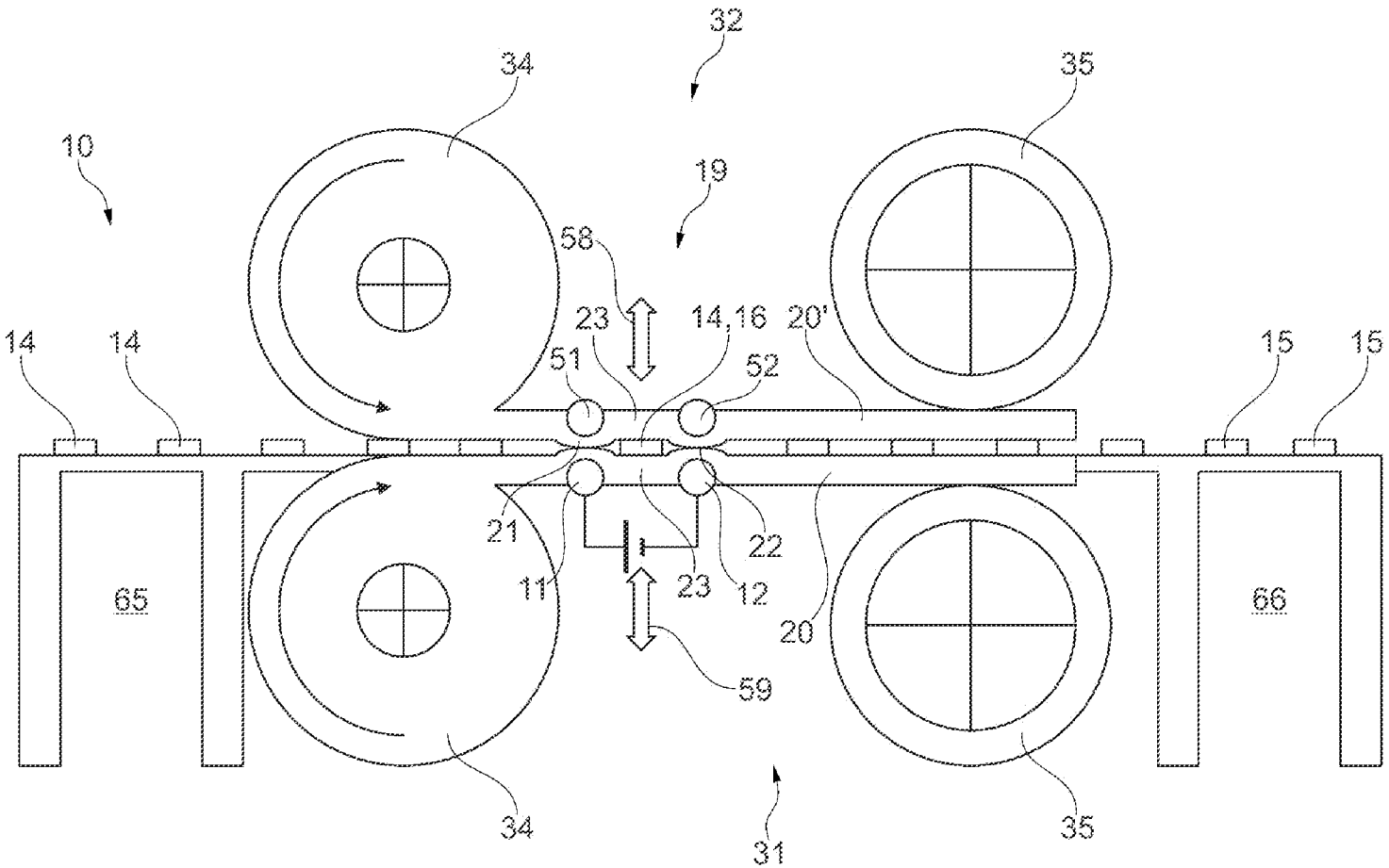
FIG. 5: a fifth exemplary embodiment of a device for sintering.

The exemplary embodiment shown in FIG. 5 is also similar in structure to FIG. 3, so that only the differences are discussed here and otherwise reference is made to above. Deviating from FIG. 3, both surface elements 20, 20' are here provided quasi endlessly on respective rolls 34. Both the first conveying device 31 and the second conveying device 32 are configured for holding and transporting the partially unrolled surface element 20, 20'. For this purpose, they each have a second roller 35 which, together with the roller 34, clamps and moves the partially unrolled surface element 20, 20'. In this way, sintering with a damaged surface element is avoided and a particularly high, consistent quality of the sintered bodies is ensured.

Other possibilities are conceivable. For example, it is also possible to combine a lower conveying device with a counter element from FIG. 4 with the upper roller 34 from FIG. 4.

Figure 6:
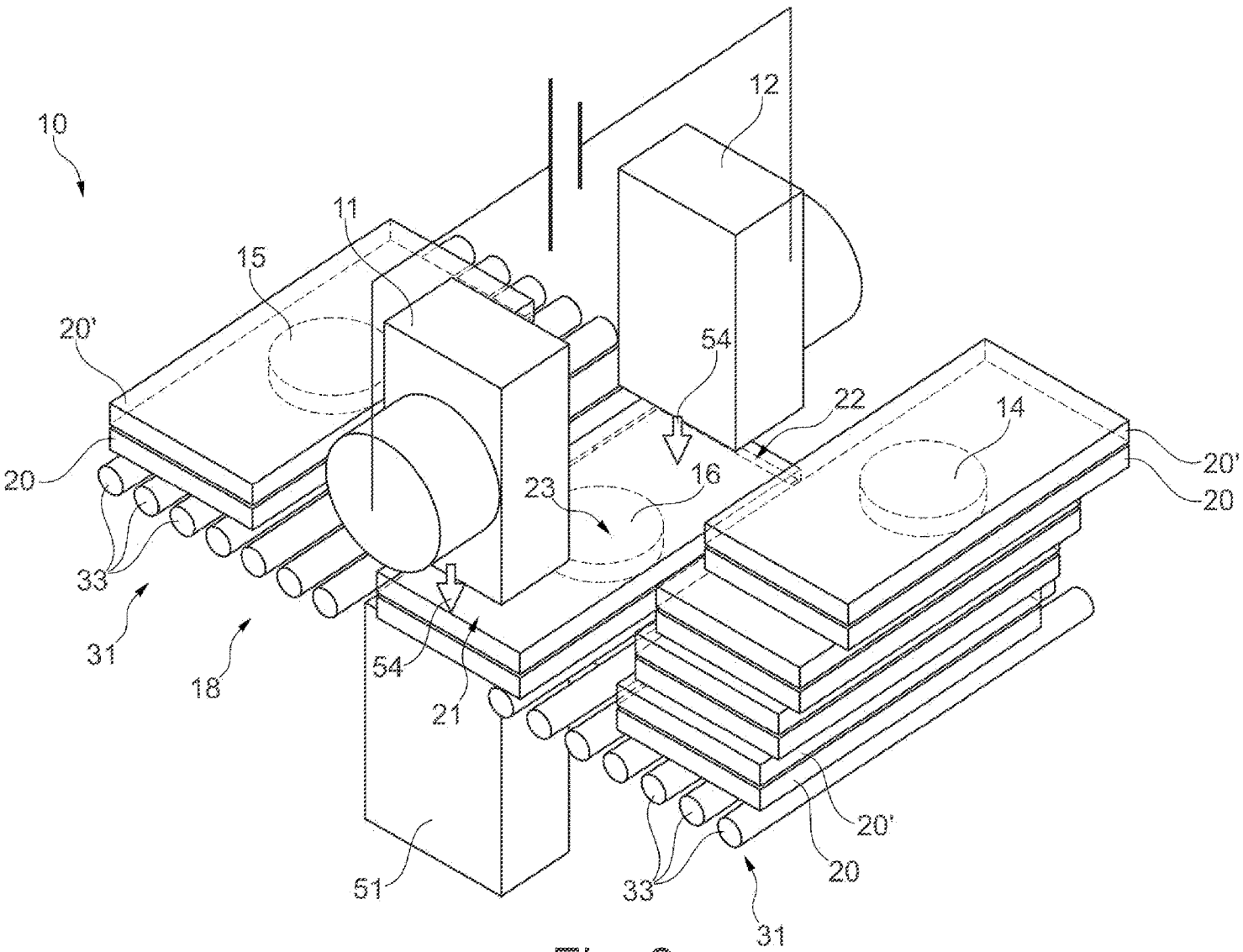
FIG. 6: a sixth exemplary embodiment of a device for sintering.

Another exemplary embodiment is shown in FIG. 6. Here, the first conveying device 31 comprises a plurality of parallel transport rollers 33. These are configured to move respective sections of the surface element 20, 20' limited in area with sandwiched green bodies or sintered bodies therebetween in a substantially straight line with respect to the first component 11 and the second component 12. The first conveying device 31 may be configured in one part (one-piece) such that it can move the sandwiched bodies before sintering and after sintering. The first conveying device 31 may also be configured in two parts, as shown, such that a first part transports the sandwiched green bodies 14 to the components 11, 12 and a second part transports the sandwiched sintered bodies 15 away from the components 11, 12. This device 10 can also be easily integrated into an existing continuous furnace in order to use the facilities existing there as described above. The first conveying device 31 can be part of the continuous furnace.

In the example shown here, the components 11, 12 are each designed as a rectangular block which has a contact surface on the underside for contacting the surface element and an electrical connection area arranged on the side. A corresponding counter component 51, 52 is arranged below each component 11, 12.

The components 11, 12 are shown in the open position 18. Thus, by means of the first conveying device 31, a sintered body 15 can be transported away and a green body 14 can be brought between the components 11, 12 and the counter components 51, 52. For closing, the components 11, 12 can be moved individually or together along the arrows 54 vertically downwards, so that the first component 11 contacts a first region 21 of the surface element 20' and the second component 12 contacts a second region 22 of the surface element 20'. Now the circuit can be closed so that the third region 23 with the green body 14 located in the sintering position 16 is heated for sintering. Again, a quasi-continuous method is possible. The sandwiched green bodies can, for example, be placed on and/or removed from transport rollers 31 by means of a manipulator (not shown).

Here, too, the surface elements 20, 20' are used only once for the reasons described. In deviation from what is shown, heating can also be performed on one side by replacing one of the surface elements 20, 20' with a corresponding counter element.

Figure 7:
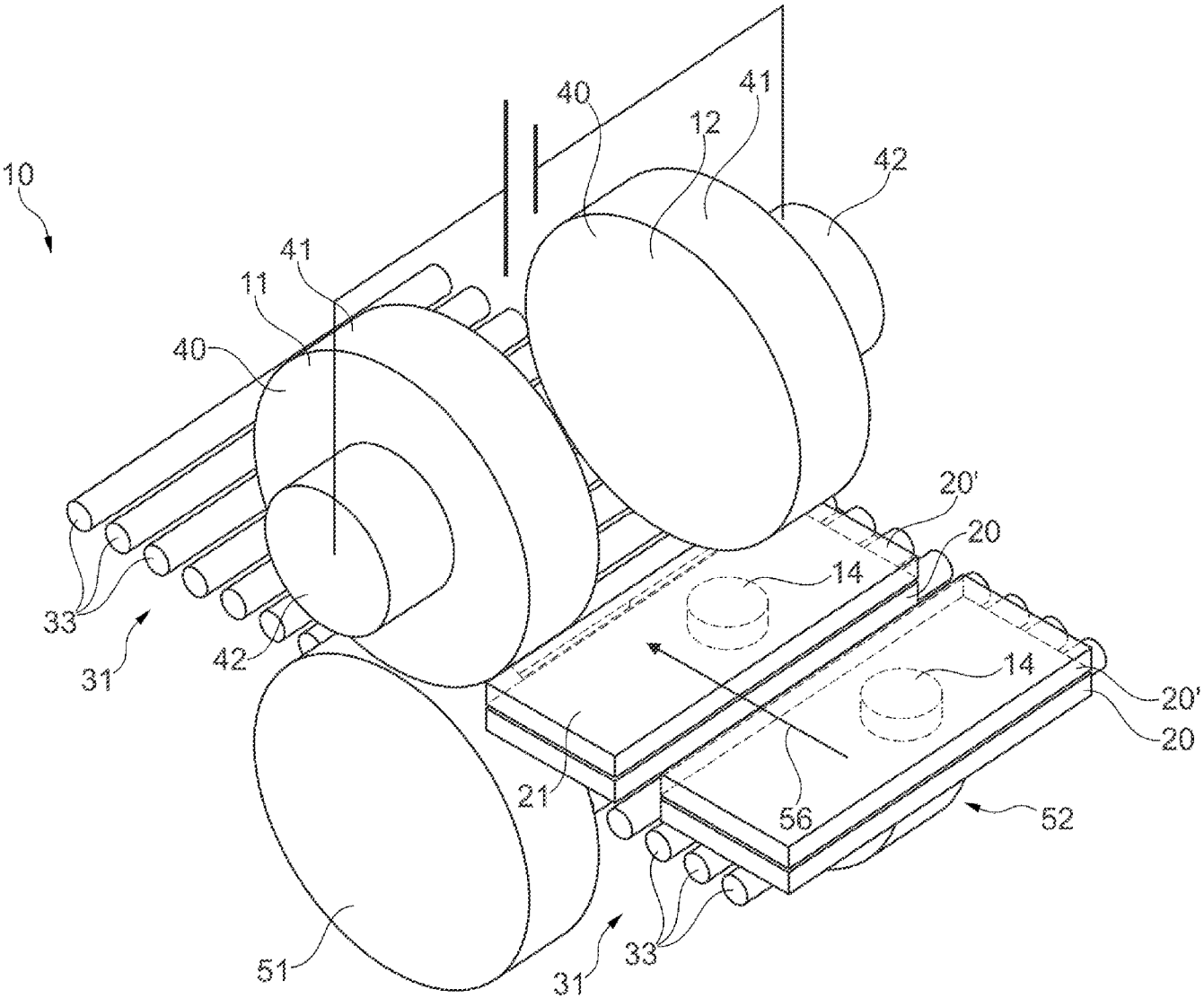
FIG. 7: a seventh exemplary embodiment of a device for sintering.

A similar device 10 is shown in FIG. 7, so that only the differences are discussed here as well. Deviating from FIG. 6, each of the components 11, 12 is designed here as a roller-shaped electrode 40 rotatable about a horizontal axis. The electrodes 40 have a circumferential surface 41 for electrically conductively contacting the surface element 20' and an electrical connection area 42. The sizes and proportions, especially of the electrodes, are not to scale. The relative movement here is between the electrodes 40 and the surface elements 20'. The sandwiched green bodies are moved along the direction 56 by means of the conveying rollers 33 until they reach the electrodes 40. Through the contact between the electrodes 40 and the surface element 20', both surface elements 20, 20' are heated and sintering takes place. Here, the two surface elements 20, 20' are clamped between the components 11, 12 and the counter components 51, 52. In this configuration, no stopping of the movement of the first conveying device is necessary for sintering. Thus, a completely continuous method is provided in which the transport and sintering take place without interruptions.

LIST OF REFERENCE SIGNS

Device 10
First component 11
Second component 12
Green body 14
Sintered body 15
Sintering position 16
Substrate 17
Open position 18
Closed position 19
Surface element 20, 20'
First region 21
Second region 22
Third region 23
Counter element 25
Support element 26
First conveying device 31
Second conveying device 32
Transport roller 33
Roller 34
Second roller 35
Belt 37
Conveying roller 38, 38', 39, 39'
Electrode 40
Circumferential surface 41
Connection area 42
Pyrometer 45
Cavity 46
First counter component 51
Second counter component 52
Arrow 54, 56, 58, 59
Electrically conductive screw 60
Electrically non-conductive screw 61
Insulator 62
Conductor 63
Loading zone 65
Unloading zone 66

The invention claimed is:

1. A device for sintering, comprising:
an electrically conductive first component;
an electrically conductive second component; and
at least one electrically conductive surface element for heating a green body to be sintered, wherein:
the electrically conductive first component and the electrically conductive second component are movable relative to each other and/or relative to the electrically conductive surface element in such a way that an electrical circuit comprising the electrically conductive first component, the electrically conductive surface element, and the electrically conductive second component can be closed by relative movement of the electrically conductive first component, the electrically conductive second component, and the electrically conductive surface element; and
the device further comprises a first conveying device for moving the electrically conductive surface element or a counter element substantially in a straight line so that a green body and/or a sintered body arranged on the electrically conductive surface element or the counter element can be moved relative to the electrically conductive first component and the electrically conductive second component.

2. The device according to claim 1, wherein the electrically conductive surface element includes carbon or consists of carbon.

3. The device according to claim 2, wherein a first region of the electrically conductive surface element is electrically conductively connectable or connected to the electrically conductive first component and a second region of the electrically conductive surface element is electrically conductively connectable or connected to the electrically conductive second component.

4. The device according to claim 1, wherein one side of a sintering position of the green body is delimited by the electrically conductive surface element and another side of the sintering position of the green body is delimited by a counter element.

5. The device according to claim 1, characterized in that the device comprises two electrically conductive surface elements, wherein each electrically conductive surface element delimits one side of a sintering position of the green body.

6. The device according to claim 1, wherein the device is configured to allow relative movement of the electrically conductive first component and the electrically conductive second component with respect to the electrically conductive surface element.

7. The device according to claim 1, wherein the electrically conductive surface element is provided in rolled-up form on a roll and the first conveying device is configured for holding and transporting a partially unrolled surface element.

8. The device according to claim 1, wherein the electrically conductive surface element and/or the counter element is configured as a circulating belt and the first conveying device comprises two conveying rollers for holding and moving the circulating belt.

9. The device according to claim 1, wherein the device comprises a second conveying device for moving a further electrically conductive surface element or counter element substantially along a straight line so that a green body and/or a sintered body arranged on the electrically conductive surface element or counter element can be covered with the further electrically conductive surface element or counter element when moved relative to the electrically conductive first component and the electrically conductive second component.

10. The device according to claim 1, wherein the electrically conductive first component and the electrically conductive second component are configured as rotatably mounted, roller-shaped electrodes which are configured to electrically conductively contact the electrically conductive surface element with their circumferential surface when the electrically conductive surface element is moved substantially in a straight line relative to the electrically conductive first component and the electrically conductive second component.

11. The device according to claim 1, wherein:

the device further comprises a first counter component opposite the electrically conductive first component and a second counter component opposite the electrically conductive second component;

the electrically conductive first component and the first counter component are arranged to exert a compressive force from opposite sides on a first region of the electrically conductive surface element; and the electrically conductive second component and the second counter component are arranged to exert a compressive force from opposite sides on a second region of the electrically conductive surface element.

12. The device according to claim 1, wherein the device further comprises a manipulator for moving the green body to be sintered at least in sections to a sintering position and/or for moving a sintered body at least in sections away from the sintering position.

13. A sintering plant, wherein the sintering plant is a FAST/SPS plant or a continuous furnace plant, comprising a device for sintering according to claim 1, wherein the sintering plant comprises a power source for applying an electric current through the electric circuit comprising the electrically conductive first component, the electrically conductive surface element and the electrically conductive second component.

14. A method for sintering a green body using the device according to claim 1, the method comprising:

providing the device having the electrically conductive first component, the electrically conductive second component and the at least one electrically conductive surface element;

arranging the green body to be sintered on the electrically conductive surface element;

performing a relative movement between the electrically conductive first component and the electrically conductive second component or between the electrically conductive first component, the electrically conductive second component, and the electrically conductive surface element; and applying an electric current through the electrically conductive first component, the at least one electrically conductive surface element, and the electrically conductive second component, wherein the electric current causes heating of the electrically conductive surface element so that the green body is sintered.

15. The method according to claim 14, wherein;

the electrically conductive surface element or a counter element is moved substantially in a straight line, wherein the green body is arranged on the electrically conductive surface element or the counter element and is moved together therewith relative to the electrically conductive first component and to the electrically conductive second component;

after completion of the relative movement substantially in the straight line, the relative movement takes place in which the electrically conductive first component and/or the electrically conductive second component is moved such that an electrical circuit through the electrically conductive first component, the electrically conductive surface element and the electrically conductive second component is closed; and after completion of the sintering, the electrically conductive surface element or the counter element is moved substantially in a straight line, wherein the sintered body is arranged on the electrically conductive surface element or the counter element and is moved together therewith relative to the electrically conductive first component and the electrically conductive second component.

16. The method according to claim 14, wherein the electrically conductive first component and the electrically conductive second component are each configured as a rotatably mounted, roller-shaped electrode, and that the relative movement is performed as a movement of the electrically conductive surface element substantially in a straight line, wherein the electrically conductive first component and the electrically conductive second component electrically conductively contact the electrically conductive surface element with a respective circumferential surface during the relative movement.

17. The device according to claim 1, wherein a first region of the electrically conductive surface element is electrically conductively connectable or connected to the electrically conductive first component and a second region of the electrically conductive surface element is electrically conductively connectable or connected to the electrically conductive second component.

18. A sintering plant, wherein the sintering plant is a FAST/SPS plant or a continuous furnace plant comprising a device for sintering, comprising:

an electrically conductive first component;

an electrically conductive second component; and at least one electrically conductive surface element for heating a green body to be sintered, wherein:

the electrically conductive first component and the electrically conductive second component are movable relative to each other and/or relative to the electrically conductive surface element in such a way that an electrical circuit comprising the electrically conductive first component, the electrically conductive surface element, and the electrically conductive second component can be closed by relative movement of the electrically conductive first component, the electrically conductive second component and the electrically conductive surface element;

the sintering plant further comprises a power source for applying an electric current through the electric circuit comprising the electrically conductive first component, the electrically conductive surface element and the electrically conductive second component; and the device further comprises a pyrometer for determining a temperature of the electrically conductive surface element, wherein a continuous cavity is arranged in the electrically conductive first component or in the electrically conductive second component, through which a viewing axis between the pyrometer and the electrically conductive surface element passes.

19. A device for sintering, comprising:

an electrically conductive first component;

an electrically conductive second component; and at least one electrically conductive surface element for heating a green body to be sintered, wherein:

the electrically conductive first component and the electrically conductive second component are movable relative to each other and/or relative to the electrically conductive surface element in such a way that an electrical circuit comprising the electrically conductive first component, the electrically conductive surface element, and the electrically conductive second component can be closed by relative movement of the electrically conductive first component, the electrically conductive second component, and the electrically conductive surface element;

the device further comprises a pyrometer for determining a temperature of the electrically conductive surface element; and a continuous cavity is arranged in the electrically conductive first component or in the electrically conductive second component, through which a viewing axis between the pyrometer and the electrically conductive surface element passes.

20. The device according to claim 19, wherein:

the device is configured to allow relative movement of the electrically conductive first component and the electrically conductive second component along a common axis;

in an open position, a sintering position of the green body is accessible; and in a closed position, electrical contact is established between the electrically conductive first component, the electrically conductive surface element, and the electrically conductive second component.

* * * * *